United States Patent [19]

Ishak et al.

[11] Patent Number: 5,066,312

[45] Date of Patent: Nov. 19, 1991

[54] FLEXIBLE ABRASIVES

[75] Inventors: Maher Ishak, Pte. Claire; Alexander Schwartz, Westmount, both of Canada

[73] Assignee: Abrasive Technology N.A., Inc., Westerville, Ohio

[21] Appl. No.: 398,335

[22] Filed: Aug. 25, 1989

Related U.S. Application Data

[62] Division of Ser. No. 161,940, Feb. 29, 1988, Pat. No. 4,874,478.

[30] Foreign Application Priority Data

| | | | |
|---|---|---|---|
| Feb. 27, 1987 | [CA] | Canada | 530811 |
| Mar. 13, 1987 | [CA] | Canada | 531996 |
| Oct. 21, 1987 | [CA] | Canada | 549901 |
| Nov. 20, 1987 | [CA] | Canada | 552387 |
| Jan. 7, 1988 | [CA] | Canada | 556049 |

[51] Int. Cl.[5] ..... B24D 11/00

[52] U.S. Cl. ..... 51/295; 51/298; 51/309

[58] Field of Search ..... 51/295, 298, 309

[56] References Cited

U.S. PATENT DOCUMENTS

| | | | |
|---|---|---|---|
| 4,038,047 | 7/1977 | Haywood | 51/295 |
| 4,047,902 | 9/1977 | Wiand | 51/295 |
| 4,078,906 | 3/1978 | Green | 51/309 |
| 4,084,941 | 4/1978 | Cox et al. | 51/298 |
| 4,128,972 | 12/1978 | Charvat | 51/295 |
| 4,256,467 | 3/1981 | Gorsuch | 51/309 |
| 4,826,508 | 5/1989 | Schwartz et al. | 51/295 |

FOREIGN PATENT DOCUMENTS

| | | |
|---|---|---|
| 962065 | 2/1975 | Canada . |
| 1049790 | 3/1979 | Canada . |

*Primary Examiner*—William R. Dixon, Jr.
*Assistant Examiner*—Willie J. Thompson
*Attorney, Agent, or Firm*—Fleit, Jacobson, Cohn Price, Holman & Stern

[57] ABSTRACT

An abrasive member comprises a metal film (2) attached to one surface of a flexible sheet (1), a mask (13) of plating resistant material on the exposed surface of the metal film, the plating resistant material having a multitude of discrete openings (14) therein, and metal (3) electrodeposited through the discrete openings onto the metal film in the presence of particulate abrasive material so that the material adheres directly to the metal film and the abrasive (4) is embedded in the metal deposits.

17 Claims, 1 Drawing Sheet

FLEXIBLE ABRASIVES

This is a divisional of application Ser. No. 07/161,940, filed Feb. 29, 1988, now U.S. Pat. No. 4,874,478.

BACKGROUND OF THE INVENTION

This invention relates to a flexible abrasive member particularly suitable for abrading, grinding, smoothing, and finishing operations on stone, glass and other materials in heavy-duty applications.

U.S. Pat. No. 4,256,467, issued Aug. 17, 1981, to Ian Gorsuch discloses a flexible abrasive member comprising a flexible non-conductive mesh carrying a multitude of nickel deposits in which abrasive material, such as diamond grit, is embedded.

According to the Gorsuch patent, the flexible abrasive member is manufactured by first laying a sheet of flexible non-conductive mesh material onto a smooth electrically conductive surface, suitably masked to expose only those surface portions where electrodeposition is desired, so that the mesh material is in immovable relationship with the conductive surface. Nickel is then electrodeposited onto the exposed portions of the smooth surface through the mesh material in the presence of abrasive material so that the abrasive material becomes embedded in the metal layer and the mesh becomes embedded in the nickel deposits. Finally, the mesh is stripped from the electrically conductive surface and cut into the desired shape.

There are, however, a number of disadvantages associated with the process. The preparation of the cylinder prior to each deposition is expensive and complex. The process is slow and can only operate on a batch basis because a sheet of flexible mesh material of specific size must be attached to the cylinder, applied under tension, and maintained in immovable relationship therewith.

More importantly, the product produced by the Gorsuch process is structurally weak and only suitable for light-duty operations, such as lens grinding. If the product is used in heavier duty applications, such as abrading belts, the mesh has to be bonded to a suitable substrate. The heat generated during the abrading operation makes it difficult to provide a satisfactory bond, and difficulties have been experienced due to the belts breaking, the nickel deposits chipping off the intrinsically weak mesh, and delamination of the belts.

Our co-pending Canadian Application No. 518,201, filed on Sept. 15, 1986, describes a method which overcomes the problems relating to the preparation of the conductive cylinder and permits continuous operation of the process. In this method the mask is applied directly to the mesh, which is rendered conductive, instead of to the conductive surface. When a mesh is employed, however, the abrasive member must still be bonded to a strong substrate for heavy-duty applications.

BRIEF SUMMARY OF THE INVENTION

An object of the invention is to provide a flexible abrasive member, which is made faster and more economically than the one set forth in co-pending Canadian Application No. 518,201, and which can be readily made by automation. Furthermore, the invention provides abrasive sheets which can be made into pads, discs, or belts, capable of operating at higher abrading speeds and presenting a clean surface with clearly defined spaces between the metal deposits. This gives a more efficient abrading action and requires less metal or abrasive material, making the product more economical to manufacture. More significantly, the invention provides an abrasive sheet for use in heavy-duty applications without the need for subsequent lamination to a backing material. The abrading member dissipates heat efficiently and thus has a longer life.

The present invention provides an abrasive member, comprising a metal film fixedly attached to one surface of a flexible sheet made by applying a mask of plating resistant material to the exposed surface of the metal film, the plating resistant material having a multitude of discrete openings therein, and depositing metal directly through the discrete openings onto the metal film in the presence of a particulate abrasive material so that the metal adheres directly to the metal film and the abrasive material becomes embedded in the metal deposits.

The deposition is preferably carried out by electrodeposition although electroless deposition can be employed. The preferred metal for the film is copper and for the metal deposits nickel, although other combinations can be employed.

The abrasive member produced by this process is useful per se. However, in order to reduce the heat buildup in the member during use and thus increase its efficiency and life expectancy, in a preferred embodiment of the present invention, the mask is stripped from the sheet after electrodeposition of the metal to expose the metal film, and the metal film between the discrete metal electrodeposits is etched away to expose the sheet.

The mask can be applied to the metal film by coating with a layer of a photopolymer and exposing the photopolymer to ultra violet light through a screen defining the openings to decompose the polymer. The coating is then developed, preferably by treatment with an alkali, such as sodium hydroxide. The photopolymer can be a dry film photopolymer, such as a dry film photopolymer supplied under the name Riston by Dupont, a laminar dry film resist supplied by Dynachem, or dry film resist supplied by Herculestic, or a liquid film resist supplied by Kodak, GAF, Dynachem, Dupont, or Fuji film. The photopolymer is desirably exposed to ultraviolet light. However, any other type of radiation which degrades the polymer such that it can be developed is suitable.

In a further aspect of the invention a flexible abrasive member is provided which is made by comprising applying to an electrically conductive metal surface of a flexible substrate a coating of a photopolymer, exposing the photopolymer to light through a screen having discrete openings to decompose said polymer, developing the coating to provide a mask having a multitude of discrete openings therein, and electrodepositing metal directly through said discrete openings onto the metal surface in the presence of a particulate abrasive material so that the metal adheres directly to the metal surface and the abrasive becomes embedded in the metal deposits. As before, it is desirable after electrodeposition of the metal to strip the mask from the substrate sheet to expose the metal surface and etch the metal surface between the deposits to expose the substrate.

Alternatively, the mask may be applied by silk screening, in which case the mask may be made of ultraviolet light curable or thermally curable inks such as infra-red heat curable inks. Such curable plating resists and etching resists may be supplied by McDermid Inc., Dynachem and M&T Chemicals.

The flexible substrate is preferably in the form of a woven fabric, but it may be fiberglass epoxy laminate of the type used for printed circuit board applications, supplied by Westinghouse and GE, when it is desired to make abrasive pads and disks. The sheet may also be formed of a phenolic resin, such as a phenol formaldehyde resin or it may be a polyester fiberglass laminate also supplied for printed circuit board applications. Such sheets suitably have an overall thickness of about 8 to 12 mils.

For forming a flexible abrasive member suitable for use as an abrasive belt, a copper clad, fiber free resin system such as that supplied under the trademark Kapton (by Dupont), which is used for flexible printed circuits may be used. However, in a particularly desirable embodiment of the present invention, the sheet is formed of a strong woven fabric on which the metal film is deposited. A particularly suitable fabric is made of polyaramid yarn, such as p-poly (phenylene) terephthalamide yarn, which is supplied under the trademark Kevlar.

The metal film is fixedly attached to the surface of the sheet and is laminated as a film or deposited by electroless plating, vapor deposition, sputtering, or electrochemical deposition, such as electroplating. The metal may be any electrically conductive metal such as copper, aluminum, nickel, steel, rhodium or gold, but is preferably copper. Suitably the metal film has a thickness from 3/20 to 14 thousanths of an inch preferably 7/10 to 2.8 thousanths of an inch.

The abrasive material is a conventional particulate abrasive such as diamond grit or cubic boron nitride, and preferably industrial diamond. The metal can be any metal which can be deposited from a suitable bath by electrodeposition or electroless deposition and is preferably nickel or copper, more preferably nickel.

Preferably the sheet with the metal film attached thereto is continuously passed through an electrolytic bath to form a cathode, the anodes of which are formed by the metal, whereby the metal is continuously deposited in the discrete openings and during said electrodeposition the particulate abrasive is released into the bath. In order to ensure that the sheet is present in the bath as a cathode, it is connected to a source of negative potential. The sheet is preferably in contact with a smooth non-conductive surface such as a plastic surface, in the bath, which is suitably a nickel sulphamate bath. The mask, which is in the form of a very thin sheet a few thousanths, e.g. 3 to 4 thousanths of an inch thick, defines a lattice with a large number of openings, for example 1/16 of an inch in diameter.

After removal from the bath, the sheet is stripped and etched with alkaline solution. A further very significant feature of the invention is that the Kevlar TM sheet bearing the diamond-embedded nickel deposits is coated with a resin, such as a two-part polyurethane resin sold under the trade designation UR 2139X-1 and UR 2139X-1A by Elecbro Inc. After stripping and etching, the Kevlar sheet consists of a multitude of nickel nodules carried by copper segments bonded to the Kevlar fabric. The nodules hold quite well onto the fabric during use, but their tendency to chip off can be dramatically reduced by coating with the polyurethane resin. This fills the interstices between the nodules, thereby reducing the shearing forces as the fabric is moved over the working surface. It has been further found that the use of a filled resin, i.e. a resin filled with a solid particulate material, particularly silicon carbide powder further inhibits the lateral movement of the nodules reducing even further their tendencies to chip off.

In a still further feature of the invention, the nickel nodules have predetermined characteristic shapes. In one embodiment, the nodules have a crescent-moon shape. This has the effect of minimizing the use of diamond without impairing the abrasive properties. The removal of abraded material can also be assisted by careful design of the shapes of the nodules. The photographic and silk-screen processes described above lend themselves particularly well to the fabrication of shaped nodules.

BRIEF DESCRIPTION OF THE DRAWINGS

The invention will now be described in more detail, by way of example only, with reference to the accompanying drawings, wherein.

DETAILED DESCRIPTION

Example 1

Figure 1:
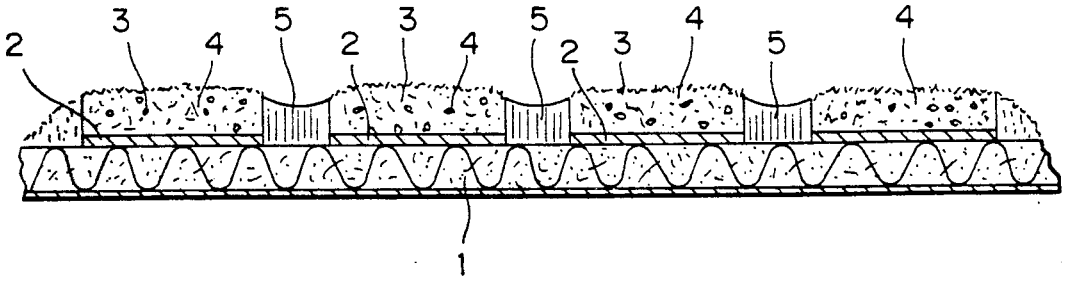
FIG. 1 is a cross-sectional view of a short length of Kevlar fabric carrying diamond-bearing nickel deposits.

A copper clad, fiberglass epoxy laminate, sold for printed circuit board applications by Westinghouse or GE, having a thickness of 8 mils to 12 mils had its copper surface mechanically cleaned with a scrubber. A dry film photopolymer supplied by Dynachem was laminated to the copper surface at about 220° F. and then exposed to ultra violet light through an apertured screen defining the holes with a Scannex exposure unit. The protective Mylar sheet, which comes with the dry film, was removed and the exposed film developed with potassium hydroxide solution.

The product bearing the photographically formed mask was then treated in a commercial electrolytic nickel sulphamate bath, supplied under the trademark SNR 24 by Hansen, operating at 170 amps and 9 volts DC at a temperature of 140-C.

The flexible abrasive member leaving the bath, though suitable for cutting and use without further treatment, was treated with a Chemalex stripper to strip off the dry photofilm and then etched with alkaline-based copper etching solution supplied by Hunt Chemicals, by spray etching.

The abrasive member had a clear translucent aesthetically pleasing appearance with well defined protuberances containing the diamond abrasive and substantially no intermediate diamond-containing metal between the protuberances. This is in contrast to the product obtained according to the process described in our copending Canadian application no. 518.210, which displayed a more untidy appearance and tended to have metal and diamond particles present between the protuberances. The clean appearance of the abrasive member has consumer appeal, particularly in the do-it-yourself market, but it also provides a more efficient abrading member. In addition it makes the product cheaper to manufacture as there is less waste of metal and abrasive material.

The presence of the copper layer has a number of advantages: It provides a smooth surface on which deposition can take place, which is important to prevent break-through of the mask and to permit even distribution of diamond grit. When the mask and copper bridging regions between the nodules are removed, the remaining copper segments under the nodules, by which the nodules are attached to the substrate, form part of the protruberances. To achieve a protuberance of given height, the electrodeposition time can be shortened due to the presence of the underlying metal segments. The metal deposits should stand upright from the substrate by an amount sufficient to permit adequate removal of abraded material and avoid undue wear.

Example 2

A 10 ounce Kevlar fabric 24×24 inches in size was subjected to electroless copper plating by passing through the standard electroless copper plating process known under the trademark Ethone System CU 701. Such a process is conventionally used for producing printed circuit boards with a copper coating of a thickness of 80 to 120 microns deposited on both sides.

The copper coated fabric was then subjected to masking and nickel and diamond deposition by the method described in example 1. The copper clad sheets can be treated in a manner similar to the fibre glass epoxy laminate.

Upon removal from the electrolytic bath, and after stripping and etching, the Kevlar sheets were coated with polyurethane resin to fill the interstices between the nickel nodules. The sheets were then cut and formed into belts after the reverse surface was covered with a rubberized epoxy resin system to prevent fraying and cutting of the belt.

Example 3

A Sheet of Barrday F-2160/175 Kevlar 29-1500 denier scoured fabric was impregnated with BO800 LOMOD TM copolyester elastomeric resin. The resin was in liquid form and applied with rollers. A layer of 10 oz. copper foil was then applied to the impregnated sheet and the assembly maintained in a press under 250 psi pressure for approximately one hour at room temperature.

Upon removal from the press, the exposed surface of the foil was mechanically scuffed to improve adhesion. A plating-resistant mask with a multitude of openings was then applied to the copper foil in the manner described above, and the laminate placed in an electrolytic deposition bath. Nickel was deposited onto the copper foil through the openings in the mask with diamond particles sprinkled into the tank during the electrodeposition.

The mask was stripped from the foil and the intervening copper etched away to leave upstanding diamond-bearing nickel deposits lying on small copper discs. The interstices between the nickel deposits were then filled with a flexible polyurethane resin, such as Elecbro UR 2139X-1 and UR 2139X-1A, so that the abrasive product presented a continuous surface on the abrasive side. As discussed above, the use of a resin coating has the important advantage that during use the tendency of the deposits to be chipped off the backing fabric is minimized. Other flexible resins can be employed.

The LOMOD TM resin substantially enhances the properties of the fabric. It prevents degradation of the fabric due to fraying and scuffing during heavy industrial use without impairing the flexibility of the belt. It has good physical, mechanical, thermal, electrical and flame-resistant properties.

Of equal significance is the fact that the LOMOD TM has sufficient strength to permit lamination of the copper foil to the fabric and good retention of the residual copper segments after stripping and etching during use.

The advantage of this technique is that unlike the copper spray, the laminated foil has a smooth surface. The uniformity of the abrasive can be accurately controlled and the tendency of the electrolytic deposits to break through the masked portions minimized.

The physical data for these LOMOD TM resins are as follows:

| | LOMOD | LOMOD |
|---|---|---|
| Property | BO800 | BO852 |
| Specific Gravity | 1.23 | 1.30 |
| Flexural Modulus, psi | 85,000 | 95,000 |
| Tensile Strength, psi | 3,350 | 3,475 |
| Tensile Elongation, % @ Break | 250 | 125 |
| Dielectric Strength | 415 | 405 |

Belts, discs and other types of abrasive product made with LOMOD TM impregnated sheets in the manner described have exceptional strength and abrasive properties.

EXAMPLE 4

A sheet of 10 ounce Kevlar TM [a trade mark of DuPont for p-poly-(phenylene)terephthalamide yarn] 24 by 24 fabric was bonded under heat and pressure with Lomod TM (available from General Electric) resin to a copper sheet having a surface density of one ounce per square foot. The surface of the copper sheet was cleaned and scrubbed with an abrasive brush in a scrubbing machine.

The cleaned laminate was passed through a dry film laminator made by Thiokol/Dynachem Company (Model 30) to apply a Riston (a trade mark of DuPont) photo-resist film (an alternative is Dynachem film).

Laminate with the applied photo-resist film was placed in a Scannex II exposure unit with a screen defining the desired pattern of crescent-shaped holes. The screen can be produced photographically.

After exposure to ultra violet light, the image was developed and the protective Mylar film, applied by the laminator, removed.

The electrodeposition took place in the presence of diamond grit in an electrolytic bath in a similar manner to that described above to form crescent-shaped diamond-embedded nickel pellets. Other abrasive particulate material, such as cubic boron nitride, can be employed, After electrodeposition, the mask and exposed copper were removed with an alkaline stripping and etching solution.

The product was then roller coated with polyurethane protective resin, having the trade designation UR 2139X-1 and UR 2139X-1A by Elecbro Inc, to fill the interstices between the nickel deposits.

The sheet was then cut into strips and the strips formed into belts ready for use as an abrasive.

Instead of using photo-resist materials to form the mask, the mask can be applied by a silk screening process. In this case, the mask is made of enplate UR 2311B silk screening material which is ultra-violet cured after application in the silk-screening process.

Referring to FIG. 1, a length of Kevlar fabric 1 is impregnated with Lomod TM and has bonded thereto copper discs 2. These discs were applied as a copper foil in the manner described above but are all that remain of the original foil after the stripping and etching operation described above.

The nickel nodules 3 are electrolytically deposited on the copper discs 1 and have diamond particles 4 embedded therein.

The voids between the nodules 3 are filled with polyurethane resin 5 in the manner described above. The resin 5 reduces lateral movement of the nodules 4 and has a profound effect on their tendency to chip off during the abrasion process. The resin has a greater effect than would result merely from its adhesive action due to the way in which it stabilizes the nodules in operation. One of the factors inhibiting widespread use of this type of abrasive product in the past has been the difficulty of retaining the nodules on the substrate in the hostile environment of an industrial abrading machine.

The sheets are cut into strips and formed into belts by making a butt joint and applying a tape on the rear side with Bostik 7070 TM adhesive. To minimize wear, the rear side should be slightly scuffed in the region where the tape is to be located so as to avoid a noticeable bump when the tape is in place. The edges should desirably be cut in a wavy line to reduce lateral movement.

Figure 2:
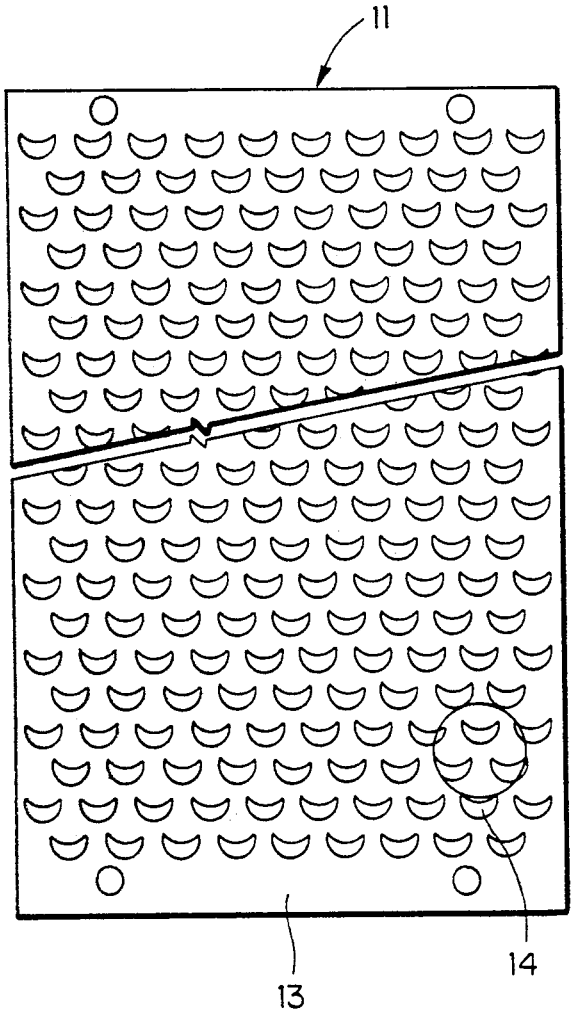
FIG. 2 is a plan view of a laminated substrate bearing a surface mask defining a regular pattern of crescent-shaped holes.

The laminate 11, shown in FIG. 2, comprises a Kevlar TM fabric resin bonded to a copper sheet 12 covered with a surface mask 13 of photo-resist material defining crescent-shaped holes 14 through which electrodeposition occurs. The laminate shown in FIG. 2 is subsequently placed in an electrolytic tank to permit deposition of nickel in the presence of diamond grit through the shaped holes 14. This process produces crescent-shaped pellets at the locations of the holes with diamond grit embedded in the nickel.

After removal from the tank, the mask and exposed copper are stripped from the Kevlar TM to leave a sheet consisting of a regular pattern of crescent-shaped pellets firmly attached to the Kevlar TM backing. Each pellet consists of an electrodeposit of nickel bearing the diamond grit carried on a crescent-shaped segment of copper bonded to the underlying fabric.

Figure 3A:
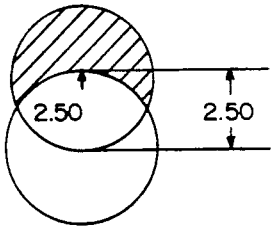
FIG. 3*a* shows a detail of one of the shaped holes.
Figure 3B:
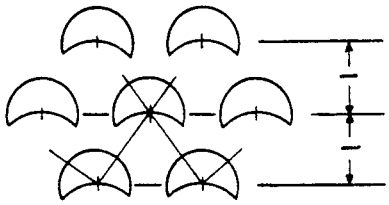
FIG. 3*b* shows a detail of a group of holes.

FIG. 3*a* shows in detail the shape of the holes. The crescent-shapes are defined by overlapping circles of slightly different radii. FIG. 3*b* shows how the holes are arranged in a symmetrical arrangement.

The manufactured sheet is subsequently cut into strips, which in turn are formed into belts. The crescent-shaped modules make the belts unidirectional, in that the convex edge has to face the direction of movement of the belt. This is generally a significant disadvantage.

The use of crescent-shapes permits significant savings in diamond grit, since the surface area of the pellets is less than for circular pellets, without deterioration in the abrasive properties, and furthermore the removal of abraded matter is improved.

The holes can have other shapes. For example, honeycomb shapes provide the belt with greater rigidity.

The spacing and size of the pellets can be varied to fine tune the properties of the abrasive product according to the intended application. A much greater degree of control can be exercised over the abrasive properties than was previously possible. For rough grinding purposes, the pellets are spaced further apart and larger diamonds employed. For smooth grinding applications, the pellets are brought closer together and smaller diamonds used.

Kevlar TM is a particularly useful material for making abrasive belts. For disks on the other hand, the copper foil can be bonded onto fiberglass or other semi-rigid material and the fiberglass then laminated onto a firm backing, for example a polyester backing.

We claim:

1. An abrasive member comprising a flexible sheet having a plurality of discrete metal protuberances fixedly attached to one surface thereof, each of said protuberances comprising a lower thin layer of a first metal fixedly attached to said flexible sheet and an upper electrodeposited layer of a second metal different from said first metal and having abrasive material embedded therein.

2. An abrasive member as claimed in claim 1 wherein said first metal is copper and said second metal is nickel.

3. An abrasive member as claimed in claim 2 wherein said abrasive material is diamond grit.

4. An abrasive member as claimed in claim 1 wherein said flexible sheet comprises a fiberglass epoxy laminate.

5. An abrasive member as claimed in claim 1 wherein said flexible sheet comprises a polyester fiberglass laminate.

6. An abrasive member as claimed in claim 1 wherein said flexible sheet comprises a woven polyaramid fabric.

7. A flexible abrasive product comprising a flexible substrate having a plurality of metal pellets bearing particulate abrasive material attached thereto, said pellets being crescent-shaped and arranged in a pattern, said pellets comprising electrodeposited metal on copper segments resin-bonded to said substrate.

8. A flexible abrasive product as claimed in claim 7 wherein said pellets are arranged in a regular pattern.

9. A flexible abrasive product as claimed in claim 7 wherein said substrate comprises a polyaramid fabric.

10. A flexible abrasive product as claimed in claim 9 wherein said fabric is coated with a copolyester resin.

11. A flexible abrasive product as claimed in claim 10 wherein said fabric is made of polyaramid yarn.

12. An abrasive product as claimed in claim 11 wherein said polyaramid yarn comprises poly(p-phenylene)terephthalamide.

13. An abrasive product as claimed in claim 10 wherein said fabric is impregnated with said resin.

14. An abrasive product as claimed in claim 10 wherein said segments are bonded to said fabric with said copolyester resin.

15. An abrasive product comprising a flexible substrate, a plurality of discrete metal pellets bearing particulate abrasive material fixedly attached to said flexible substrate, and voids between said pellets being at least partially filled with flexible filler material of polyurethane resin to reduce the shearing forces on said pellets during use.

16. An abrasive product as claimed in claim 15 wherein in said resin is filled with a particulate solid filler material.

17. An abrasive product as claimed in claim 15 wherein in said resin is filled with silicon carbide powder.

* * * * *